US012313332B2

(12) United States Patent
Harikrishnasamy et al.

(10) Patent No.: US 12,313,332 B2
(45) **Date of Patent: *May 27, 2025**

(54) APPLIANCE TRIM BREAKER

(71) Applicant: WHIRLPOOL CORPORATION, Benton Harbor, MI (US)

(72) Inventors: Arunkumar Harikrishnasamy, Stevensville, MI (US); Sai B. Krishna, Pune (IN); Abhay Naik, Stevensville, MI (US); Sanket V. Phalak, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/331,440

(22) Filed: Jun. 8, 2023

(65) Prior Publication Data

US 2023/0314065 A1 Oct. 5, 2023

Related U.S. Application Data

(63) Continuation of application No. 17/153,448, filed on Jan. 20, 2021, now Pat. No. 11,709,013.

(51) Int. Cl.

| | |
|---|---|
| ***F25D 23/06*** | (2006.01) |
| ***F25D 23/08*** | (2006.01) |
| *F25D 23/02* | (2006.01) |

(52) U.S. Cl.

CPC ..... *F25D 23/085* (2013.01); *F25D 23/082* (2013.01); *F25D 23/028* (2013.01); *F25D 23/062* (2013.01); *F25D 23/066* (2013.01)

(58) Field of Classification Search

CPC .... F25D 23/085; F25D 23/082; F25D 23/062; F25D 23/066; F25D 23/028

See application file for complete search history.

(56) References Cited

U.S. PATENT DOCUMENTS

| | | | |
|---|---|---|---|
| 2,587,922 | A | 3/1952 | Sulcek |
| 2,644,603 | A | 7/1953 | Hinkel et al. |
| 5,720,536 | A | 2/1998 | Jenkins et al. |
| 6,485,122 | B2 | 11/2002 | Wolf et al. |
| 8,943,770 | B2 | 2/2015 | Sanders et al. |
| 9,810,477 | B2 | 11/2017 | Sul et al. |
| 10,174,989 | B2 | 1/2019 | Jung et al. |
| 10,612,834 | B2 | 4/2020 | Allard et al. |
| 10,807,298 | B2 | 10/2020 | Allard et al. |
| 10,914,514 | B1 | 2/2021 | Hunter et al. |
| 11,340,008 | B1 | 5/2022 | Hunter et al. |
| 11,448,355 | B2 | 9/2022 | Ekshinge et al. |
| 11,486,629 | B2 | 11/2022 | Harikrishnasamy et al. |
| 2016/0258671 | A1 | 9/2016 | Allard et al. |
| 2017/0292776 | A1 | 10/2017 | Kim et al. |
| 2020/0406527 | A1 | 12/2020 | Allard et al. |
| 2022/0282905 | A1 | 9/2022 | Hunter et al. |

FOREIGN PATENT DOCUMENTS

WO 2018022009 A1 2/2018

*Primary Examiner* — Kimberley S Wright

(74) *Attorney, Agent, or Firm* — Price Heneveld LLP

(57) ABSTRACT

A trim breaker includes first and second opposing vertical portions, a top portion, and a bottom portion. An outer rim extends about a periphery of the trim breaker. An inner edge is spaced interiorly from the outer rim. The trim breaker further includes a first surface proximate the inner edge and a second surface proximate the outer rim. A pair of parallel ribs extend from the outer rim toward the inner edge. Further, the first surface extends outward from the second surface, thereby forming a plateau.

20 Claims, 6 Drawing Sheets

APPLIANCE TRIM BREAKER

CROSS-REFERENCE TO RELATED APPLICATION

The present application is a continuation of U.S. patent application Ser. No. 17/153,448, filed Jan. 20, 2021, now U.S. Pat. No. 11,709,013, which is entitled APPLIANCE TRIM BREAKER, the entire disclosure of which is hereby incorporated herein by reference.

BACKGROUND OF THE DISCLOSURE

The present disclosure generally relates to a trim breaker for an appliance, and more specifically, a trim breaker for an appliance including reinforcement members.

SUMMARY OF THE DISCLOSURE

According to one aspect of the present disclosure, a trim breaker for an appliance includes first and second opposing vertical portions, a top portion, and a bottom portion, which form corners and are configured to extend between an inner liner and an outer wrapper of a refrigerating appliance. An outer rim extends about a periphery of the trim breaker. An inner edge is spaced interiorly from the outer rim. A central corner rib extends from the outer rim and is positioned diagonally across one of the corners. A pair of outer ribs is positioned on opposing sides of the central corner rib. The pair of outer ribs are integrally formed with the central corner rib proximate the inner edge, thereby forming a joint.

According to another aspect of the present disclosure, a trim breaker for an appliance includes first and second opposing vertical portions, a top portion, and a bottom portion. An outer rim extends about a periphery of the trim breaker. An inner edge is spaced interiorly from the outer rim. The trim breaker further includes a first surface proximate the inner edge and a second surface proximate the outer rim. A pair of parallel ribs extend from the outer rim toward the inner edge. The first surface extends outward from the second surface, thereby forming a plateau.

According to yet another aspect of the present disclosure, a trim breaker for an appliance includes first and second opposing vertical portions, a top portion, and a bottom portion, the top portion integrally formed with each vertical portion at respective upper corners and the bottom portion integrally formed with each vertical portion at respective lower corners. An outer rim extends about a periphery of the first and second opposing vertical portions, the top portion, and the bottom portion. An inner edge defines an opening, wherein the inner edge is interior of the outer rim. At least one pair of parallel ribs extend from the outer rim toward the inner edge. The first surface extends outward from the second surface, thereby forming a plateau.

These and other features, advantages, and objects of the present disclosure will be further understood and appreciated by those skilled in the art by reference to the following specification, claims, and appended drawings.

Figure 1:
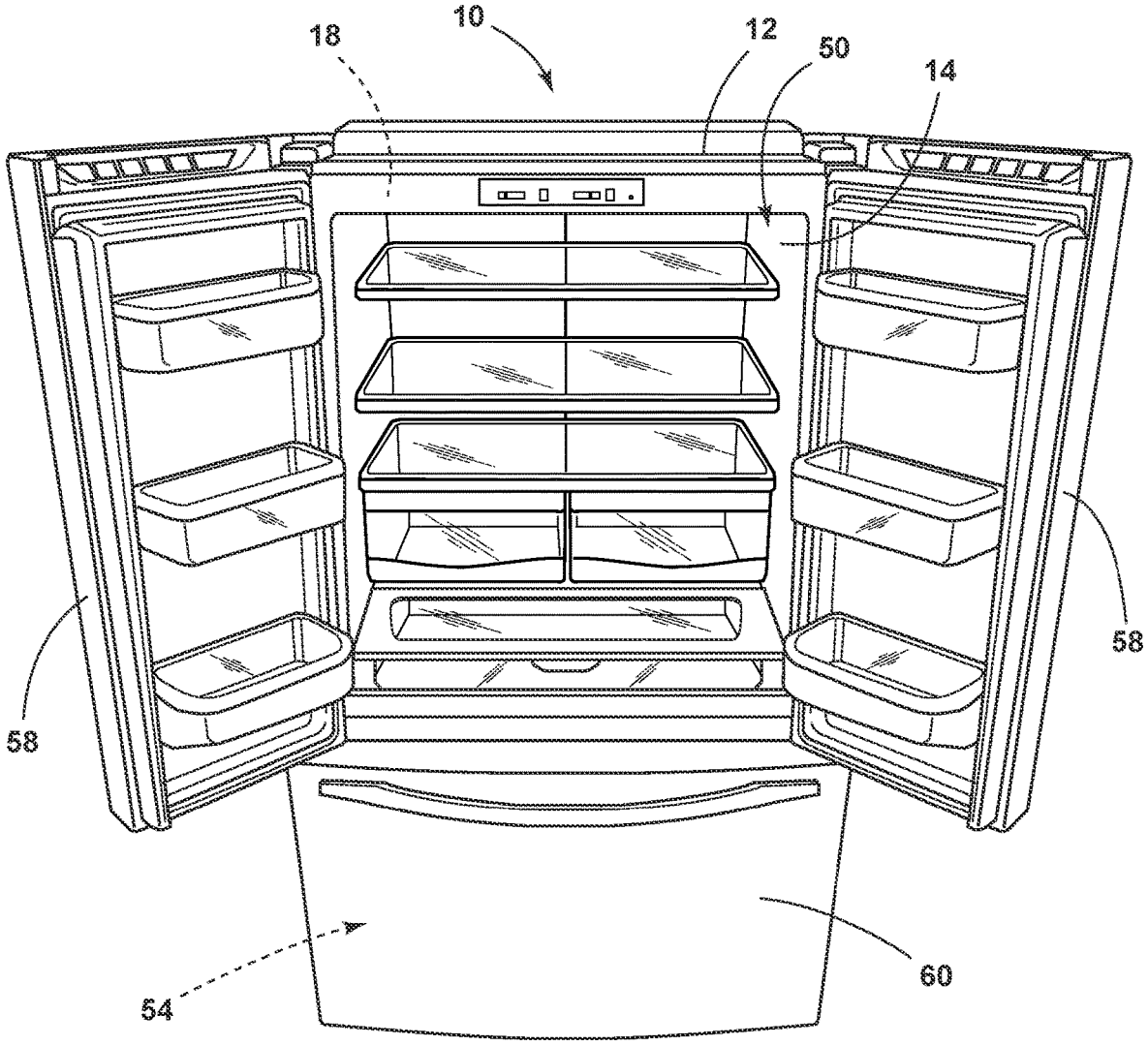
FIG. 1 is a front perspective view of a refrigerator appliance including a trim breaker.

The components in the figures are not necessarily to scale, emphasis instead being placed upon illustrating the principles described herein.

DETAILED DESCRIPTION

The present illustrated embodiments reside primarily in combinations of method steps and apparatus components related to a trim breaker for an appliance including a plurality of ribs. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-5, reference numeral 10 generally designates a refrigerator appliance including a cabinet 12. The cabinet 12 includes an inner liner 14 spaced apart from an outer wrapper 16. A trim breaker 18 extends between the inner liner 14 and the outer wrapper 16 to define an insulating cavity 20 therebetween. The trim breaker 18 includes first and second opposing vertical portions 22, 24, a top portion 26, a bottom portion 28, and a central portion 30. The top portion 26 is integrally formed with each vertical portion 22, 24 at a respective upper corner 32, and the bottom portion 28 is integrally formed with each vertical portion 22, 24 at a respective lower corner 34. The trim breaker 18 includes an inner surface facing the insulating cavity 20 and an exterior surface opposite the interior surface (e.g., facing outwardly from the cabinet 12). A first plurality of ribs 36 extends from an outer rim 38 of at least one of the first and second vertical portions 22, 24 and at least partially along the central portion 30. A second plurality of ribs 40 extends from the outer rim 38 of at least one of the first and second vertical portions 22, 24 and across at least one of the upper corners 32 or the lower corners 34.

Figure 2:
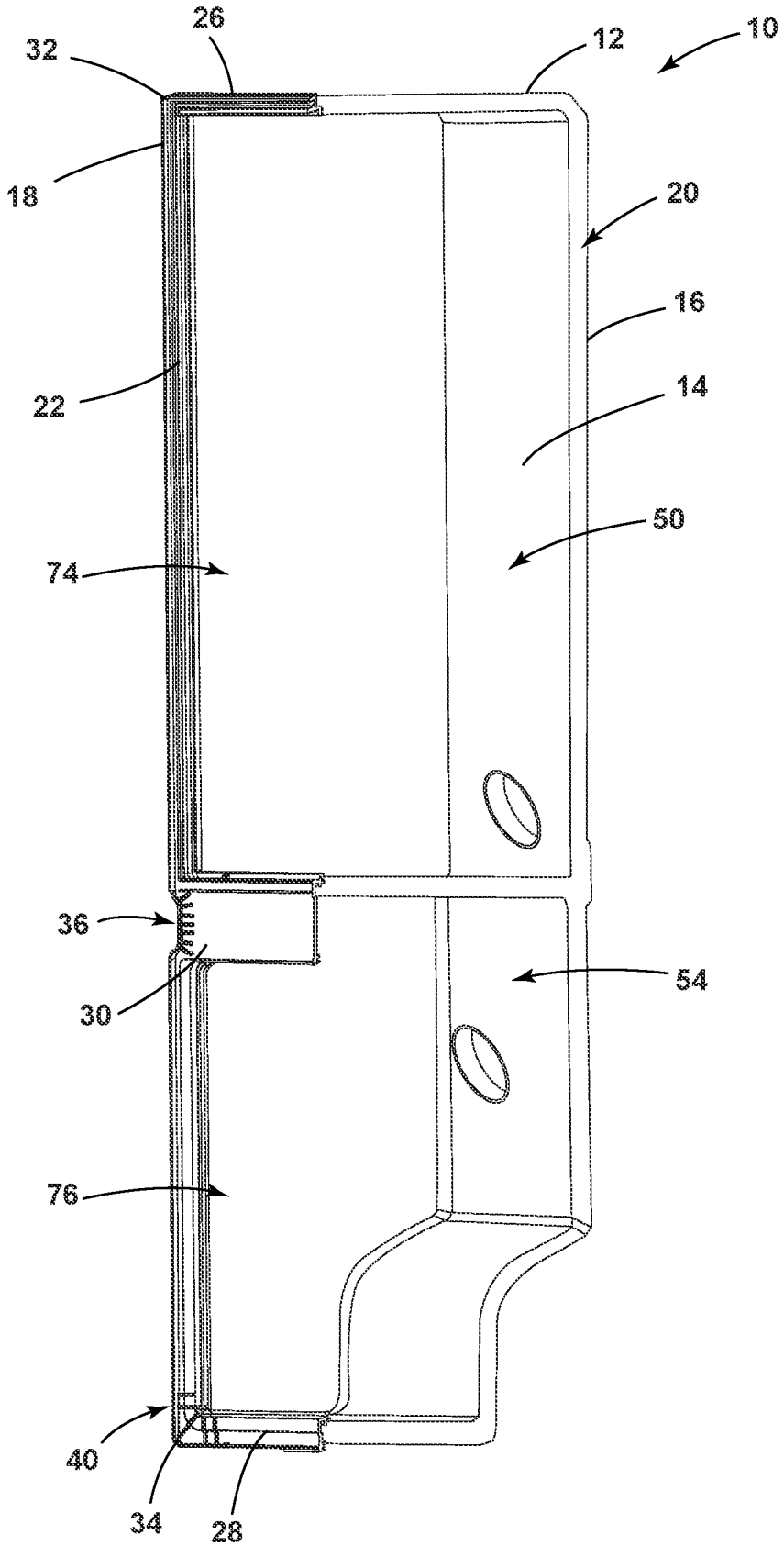
FIG. 2 is a side cross-sectional perspective view of a refrigerator cabinet of the refrigerator appliance of FIG. 1.

Referring now to FIGS. 1 and 2, the refrigerator appliance 10 is depicted as a French-door bottom-mount refrigerator, but it will be understood that the refrigerator appliance 10 may be a side-by-side refrigerator, a bottom mount refrigerator, or a top mount refrigerator. The refrigerator appliance 10 includes the cabinet 12 defining a refrigeration compartment 50 and a freezer compartment 54. The refrigeration compartment 50 may be a fresh food compartment configured to store food stuffs or perishables at temperatures above freezing (e.g., maintained at about 3° C. or about 4° C.) for a long time period. The freezer compartment 54 may be maintained at a subzero temperature (e.g., temperatures at or below about 0° C.) for long term storage of perishables in a frozen state. One or more refrigeration doors 58 are provided for the refrigeration compartment 50, and a freezer door 60 is provided for the freezer compartment 14.

Referring now to FIG. 2, the trim breaker 18 is coupled with the inner liner 14 and the outer wrapper 16 of the cabinet 12 to seal the insulation cavity 20. In other words, the trim breaker 18 may be positioned forward of the inner liner 14 and the outer wrapper 16 to form a front edge or surface of the cabinet 12 and is positioned such that the trim breaker 18 at least partially defines the insulation cavity 20. The trim breaker 18 may be coupled with the inner liner 14 and the outer wrapper 16 by a liner coupling portion and a wrapper coupling portion, respectively. Each portion 22, 24, 26, 28, 30 of the trim breaker 18 may define coupling spaces or other coupling features configured to facilitate coupling the trim breaker 18 with inner liner 14 and the outer wrapper 16 to further seal the insulation cavity 20. It will be understood that the trim breaker 18 may be coupled with one or both of the inner liner 14 and the outer wrapper 16 based on the configuration of the appliance 10 and corresponding cabinet 12.

As previously introduced, the trim breaker 18 includes an outer rim 38 extending about a periphery of the trim breaker 18. The outer rim 38 is integrally formed with the vertical portions 22, 24, the top portion 26, and the bottom portion 28 and extends outward from the cabinet 12 when the trim breaker 18 is coupled with the cabinet 12. It is contemplated that the outer rim 38 may extend about only a portion of the periphery of the trim breaker 18 or may be formed of multiple sections positioned about the periphery of the trim breaker 18 without departing from the scope of the present disclosure.

As previously introduced, the trim breaker 18 includes the first and second vertical portions 22, 24, the top portion 26, and the bottom portion 28. The top portion 26 and the bottom portion 28 extend between the first and second vertical portions 22, 24 and may be integrally formed with the first and second vertical portions 22, 24 as a single piece. Each of the first and second vertical portions 22, 24 is joined with the top portion 26 at a respective upper corner 32, and each of the first and second vertical portions 22, 24 is joined with the bottom portion 28 at a respective lower corner 34. The upper and lower corners 32, 34 may be beveled or may be substantially angular.

Figure 3:
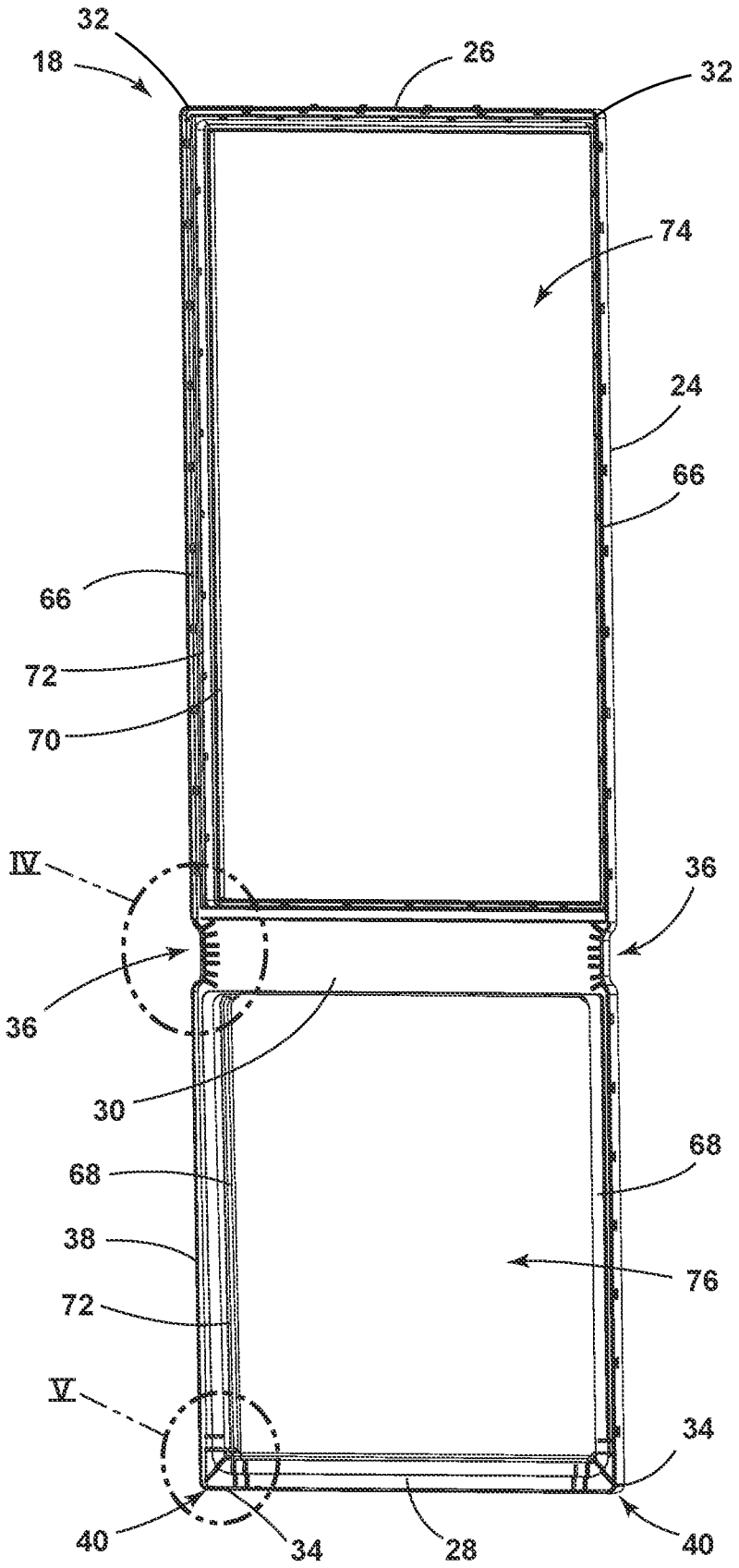
FIG. 3 is a side cross-sectional elevational view of a refrigerator cabinet of the refrigerator appliance of FIG. 1.

The trim breaker 18 may further include the central portion 30, as illustrated in FIGS. 2 and 3. The central portion 30 extends between the first and second vertical portions 22, 24 and may be integrally formed with the first and second vertical portions 22, 24 such that the trim breaker 18 is formed as a single piece. As shown in FIG. 2, the central portion 30 is positioned between the top and bottom portions 26, 28 to divide the cabinet 12 between a first compartment and a second compartment (e.g., the refrigeration compartment 50 and the freezer compartment 541. The central portion 30 further separates each of the first and second vertical portions 22, 24 into an upper section 66 and a lower section 68. The upper sections 66 of each of the first and second vertical portions 22 are positioned on opposing sides of the refrigeration compartment 50, and the lower sections 68 of each of the first and second vertical portions 22, 24 are positioned on opposing sides of the freezer compartment 54.

Referring still to FIGS. 2 and 3, an upper inner edge 70 extends along the upper sections 66 of each of the first and second vertical portions 22, 24, the top portion 26, and the central portion 30. The upper inner edge 70 is positioned within and spaced apart from the outer rim 38 by the top portion 26 and the upper sections 66 of the first and second vertical portions 22, 24 and extends along an upper edge of the central portion 30. In various examples, the upper inner edge 70 may extend forward of the trim breaker 18 in the same direction as the outer rim 38 and may be configured to form an inner rim. In other examples, the upper inner edge 70 may be substantially aligned with the portions 22, 24, 26, 28, 30 of the trim breaker 18.

A lower inner edge 72 extends along the bottom portion 28, the central portion 30, and the lower sections 68 of each of the first and second vertical portions 22, 24. The lower inner edge 72 is positioned within and spaced apart from the outer rim 38 along the bottom portion 28 and the lower sections 68 of the first and second vertical portions 22, 24 and extends along a lower edge of the central portion 30. In various examples, the lower inner edge 72 may extend forward of the trim breaker 18 in the same direction as the outer rim 38 and may be configured to form an inner rim. In other examples, the lower inner edge 72 may be substantially aligned with the portions 22, 24, 26, 28, 30 of the trim breaker 18.

As best shown in FIG. 2, the upper inner edge 70 defines an upper opening 74, and the lower inner edge 72 defines a lower opening 76. When the trim breaker 18 is coupled with the cabinet 12, the upper opening 74 is configured to be in communication with the refrigeration compartment 50, and the lower opening 76 is configured to be in communication with the freezer compartment 54 (see FIG. 2). In this way, the central portion 30 can be integrally formed with and transverse to the first and second opposing vertical portions 22,24, such that the central portion 30 divides the trim breaker between the upper opening 74 and the lower opening 76.

Figure 4:
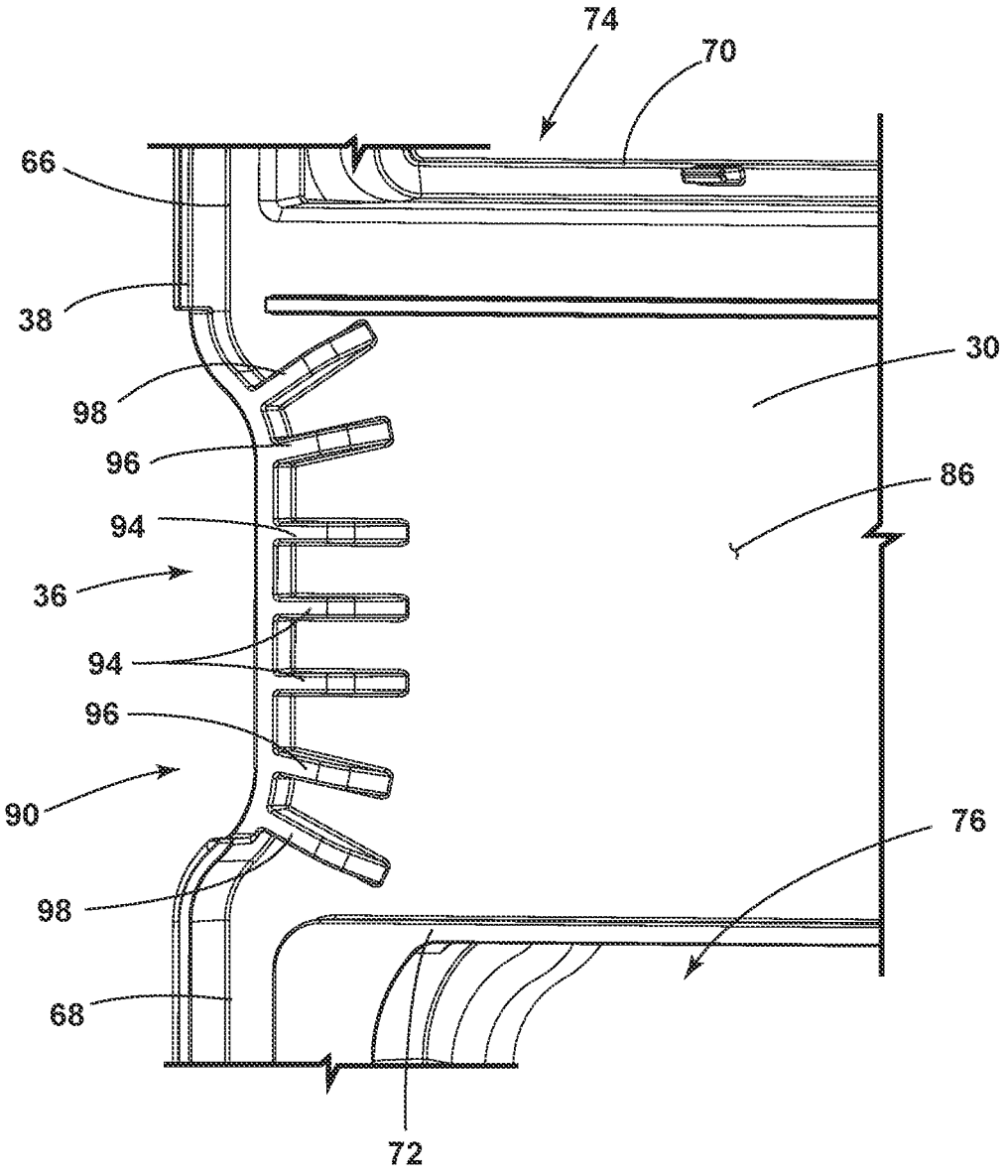
FIG. 4 is an enlarged partial side elevational view of a central portion of the trim breaker of FIG. 3.

As best shown in FIGS. 3 and 4, the central portion 30 includes an outer surface 86 extending between the upper inner edge 70 and the lower inner edge 72. The outer surface 86 extends horizontally between the first and second vertical portions 22, 24 of the trim breaker 18 and is integrally formed therewith. In various examples, each of the first and second vertical portions 22, 24 may include a space 90 proximate the central portion 30. The space 90 may be defined by the outer rim 38 and may be sized to correspond to the distance between the upper and lower inner edges 70, 72 spaced apart by the central portion 30. The outer rim 38 extends inward toward the central portion 30 to define the space 90 such that the space 90 is aligned with a corresponding end of the central portion 30.

As previously introduced, the trim breaker 18 may include a first plurality of ribs 36. As illustrated in FIG. 3, the first plurality of ribs 36 is positioned on one of the first and second vertical portions 22, 24 of the trim breaker 18. While only the first vertical portion 22 is described in detail as having a first plurality of ribs 36, it will be understood that the second vertical portion 24 may also include a corresponding first plurality of ribs 36. The positioning of the ribs on each of the vertical portions 22, 24 may be configured to be symmetric or may vary without departing from the scope of the present disclosure. Further, as best illustrated in FIG. 4, the first plurality of ribs 36 may be integrally formed with the outer rim 38 proximate the space 90 and extending therefrom. Moreover, the first plurality of ribs 36 can project, or extend, from the exterior surface, or outer surface 86, of the central portion 30 such that the first plurality of ribs 36 can be orthogonal with respect to the exterior surface 86 of the central portion 30.

Each of the first plurality of ribs 36 extends from the outer rim 38 proximate the space 90 and along the outer surface 86 of the central portion 30. The first plurality of ribs 36 includes one central rib 94 extending horizontally along the central portion 30. The at least one central rib 94 may be one of multiple central ribs 94 spaced apart along the outer edge 38 of the trim breaker 18. Each of the central ribs 94 may extend substantially perpendicularly from the outer edge 38 of the trim breaker 18, as best shown in FIG. 4. The central ribs 94 may be spaced equidistantly along the outer rim 38 or the central ribs 94 may be unevenly spaced along the outer rim 38.

With continued reference to FIG. 4, the first plurality of ribs 36 may include angled ribs 96, 98 positioned on opposing sides of the central rib(s) 94. The first plurality of ribs 36 may have one or more interior angled ribs 96 extending from the outer rim 38 of the trim breaker 18 along the central portion 30 and toward one of the upper and lower inner edges 70, 72. As shown, the interior angled ribs 96 may be positioned in pairs such that the central ribs 94 are framed by the interior angled ribs 96. The first plurality of ribs 36 may further have one or more exterior angled ribs 98 positioned to extend from the outer rim 38 of the trim breaker 18 toward one of the upper and lower inner edges 70, 72. The first plurality of ribs 36 is arranged such that the interior angled ribs 96 are positioned between the exterior angled ribs 98 and the central ribs 94. It will be understood that the first plurality of ribs 36 may include any number of central ribs 94 and any number of angled ribs 98 without departing from the scope of the present disclosure.

Figure 5:
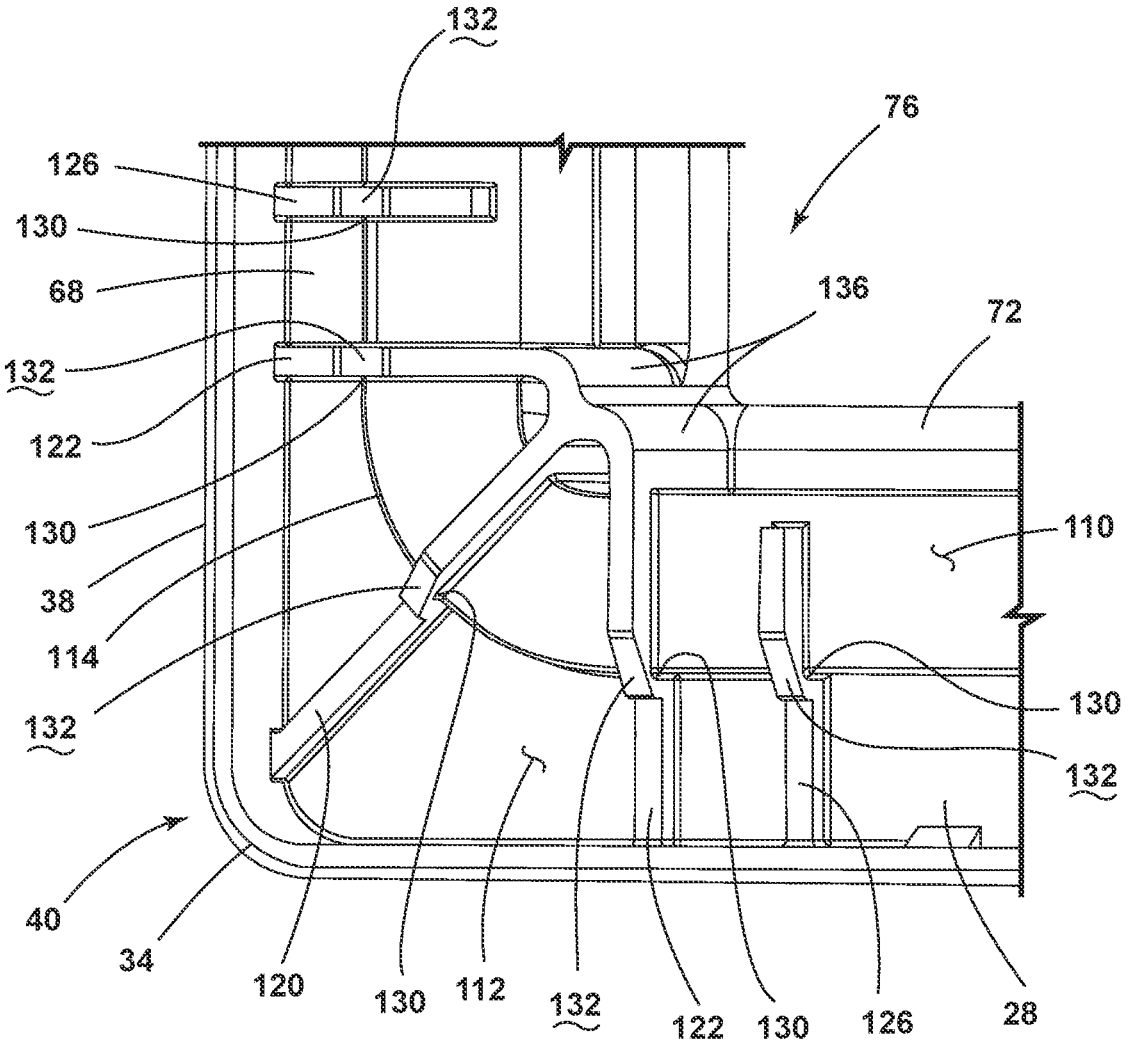
FIG. 5 is an enlarged partial side elevational view of a corner of the trim breaker of FIG. 3.

Referring now to FIGS. 3 and 5, the trim breaker 18 may include a second plurality of ribs 40 at one of the lower corners 34. It will be understood that the trim breaker 18 may include the same or similar arrangement of a plurality of ribs 40 on each of the lower corners 34 and may include the same or a similar arrangement of a plurality of ribs 40 on one or more of the upper corners 32 without departing from the scope of the present disclosure.

As best shown in FIG. 5, the bottom portion 28 of the trim breaker 18 and the lower sections 68 of the first vertical portion 22 is illustrated. Each of the first and second vertical portions 22, 24 may include a first surface 110 and a second surface 112. The first surface 110 is positioned proximate the lower inner edge 72, and the second surface 112 is positioned proximate the outer rim 38 of the trim breaker 18. The first surface 110 may extend outward from the second surface 112 to form a plateau or step extending parallel to the outer rim 38 and/or the lower inner edge 72.

As best shown in FIG. 5, the second plurality of ribs 40 includes a central corner rib 120 positioned diagonally across the respective lower corner 34. The central corner rib 120 extends from the outer rim 38 to the lower inner edge 72 and may be integrally formed with one or both of the outer rim 38 and the lower inner edge 72. Moreover, the second plurality of ribs 40 can project from an exterior surface of the first and/or second surfaces 110, 112 such that the second plurality of ribs 40 can be orthogonal with respect to the exterior surface of the first and/or second surfaces 110, 112. The second plurality of ribs 40 may further includes a first pair of outer ribs 122 positioned on opposing sides of the central corner rib 120. Each of the first pair of outer ribs 122 extends substantially perpendicularly from the outer rim 38 and across one of the bottom portion 28 and the vertical portion 22. For example, one of the first pair of perpendicular ribs 122 extends vertically across the bottom portion 28 between the outer rim 38 and the lower inner edge 72, and the other of the first pair of outer ribs 122 extends horizontally across the lower section 68 of the vertical portion 22 between the outer rim 38 and the lower inner edge 72. In various examples, each of the first pair of outer ribs 122 may be further integrally formed with the central corner rib 120 proximate the lower inner edge 72 to form rounded joints 136.

The second plurality of ribs 40 may further include a second pair of outer ribs 126 extending from the outer rim 38. Each of the second pair of outer ribs 126 may be positioned substantially parallel to and spaced apart from a corresponding rib of the first pair of outer ribs 122. For example, one of the second pair of outer ribs 126 extends vertically across at least part of the bottom portion 28. The other of the second pair of outer ribs 126 extends horizontally across at least part of the lower section 68 of the vertical portion 22. The second pair of outer ribs 126 may be sized to extend from the outer rim 38 toward the lower inner edge 72 and may be spaced apart from the lower inner edge 72. It will be understood that the second pair of outer ribs 126 may extend to and be integrally formed with the lower inner edge 72 without departing from the scope of the present disclosure. It will further be understood that any number of spaced apart outer ribs 122, 126 may be used without departing from the scope of the present disclosure.

With continued reference to FIG. 5, each of the second plurality of ribs 40 includes a lip 130 configured to align with the step 114 between the first and second surfaces 110, 112 of the trim breaker 18. The lip 130 may be defined such that each of the second plurality of ribs 40 is formed with and/or contacts the respective portion 22, 24, 26, 28 of the trim breaker 18 continuously along the length of the rib 120, 122, 126. Each of the second plurality of ribs 40 may include an inclined surface 132 aligned with the lip 130 configured to accommodate the offset between the first and second surfaces 110, 112 of the trim breaker 18. In this way, each rib 120, 122, 126 includes a beveled surface configured to accommodate each rib 120, 122, 126 to extend from the first surface 110 to the second surface 112.

Figure 6:
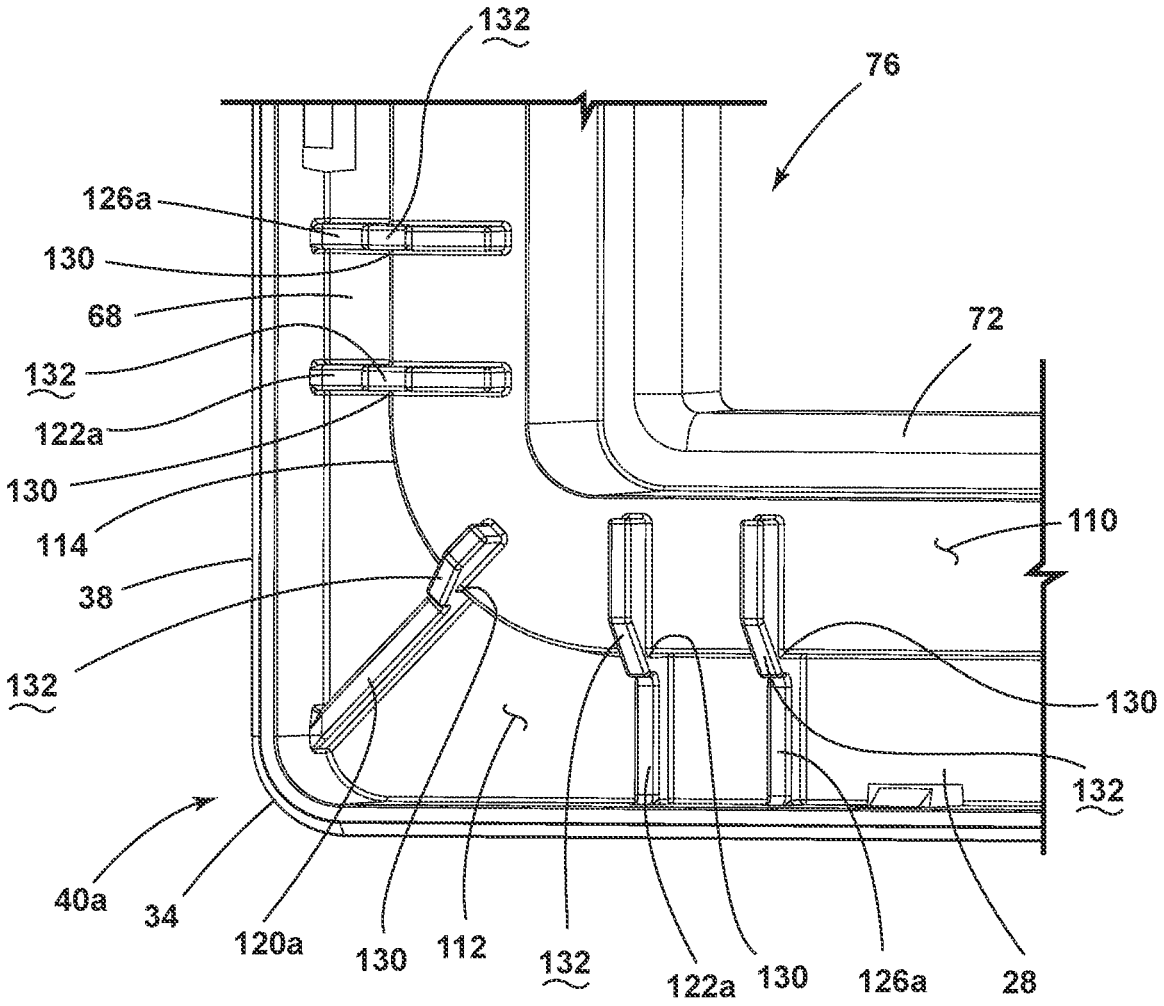
FIG. 6 is an enlarged partial side elevational view of an alternative corner of a trim breaker.

Referring now to FIG. 6, an alternate configuration of the second plurality of ribs **40*a* is illustrated. The second plurality of ribs 40*a* includes a central corner rib 120*a*, a first pair of outer ribs 122*a*, and a second pair of outer ribs 126*a*. Each of the second plurality of ribs 40 extends from the outer rim 38 toward the lower inner edge 72 and is spaced apart from the lower inner edge 72. It is contemplated that each of the second plurality of ribs 40*a* may extend the same distance from the outer rim 38** or extend varying distances without departing from the scope of the present disclosure.

It is further contemplated that one or more of the second plurality of ribs 40*a* may be joined and integrally formed at any end or may be independent from the other ribs of the second plurality of ribs 40*a*.

Referring again to FIGS. 1-6, when the trim breaker 18 is coupled with the cabinet 12, the first and second pluralities of ribs 36, 40 are configured to reduce the strain placed on the trim breaker 18 during vacuum sealing of the insulation cavity 20. The first and second pluralities of ribs 36, 40 may be configured to allow the trim breaker 18 to be made from a material having a low thermal conductivity and provide additional stiffness in the trim breaker 18. The first and second pluralities of ribs 36, 40 may also help control buckling during assembly and may help to maintain the wall thickness of the inner liner 14 and/or the outer wrapper 16 for thermal requirements by reducing the stress level in the trim breaker 18. This may also increase effectiveness of the coupling of the trim breaker 18 with the cabinet 12 (e.g., may reduce stress and strain on adhesive used therein).

According to another aspect of the present disclosure, a refrigerator appliance includes a cabinet having an inner liner spaced apart from an outer wrapper and a trim breaker extending between the inner liner and the outer wrapper to define an insulating cavity therebetween. The trim breaker includes first and second opposing vertical portions, a top portion, a bottom portion, and a central portion. The top portion is integrally formed with each vertical portion at a respective upper corner, and the bottom portion is integrally formed with each vertical portion at a respective lower corner. A first plurality of ribs extends from an outer rim of the trim breaker and at least partially along the central portion, and a second plurality of ribs extends from the outer rim of at least one of the first and second vertical portions and across at least one of the upper and lower corners.

According to another aspect, a first plurality of ribs extends from each of first and second vertical portions and along a central portion of a trim breaker.

According to another aspect, each of a first plurality of ribs is integrally formed with an outer rim of a trim breaker.

According to another aspect, a first plurality of ribs includes at least one central rib and at least one angled rib. The central rib extends substantially parallel along a central portion of a trim breaker, and the at least one angled rib extends from an outer rim of the trim breaker toward one of an upper or lower edge of the central portion.

According to another aspect, each of a second plurality of ribs is integrally formed with an outer rim of the trim breaker.

According to another aspect, a second plurality of ribs includes a central corner rib extending diagonally from an outer rim of a trim breaker to an inner edge of the trim breaker and a first pair of outer ribs extending substantially perpendicularly from the outer rim toward the inner edge.

According to another aspect, outer corner ribs are integrally formed with at least one of an inner edge of a trim breaker and a central corner rib.

According to another aspect, a second plurality of ribs includes a second pair of outer corner ribs extending substantially perpendicularly from an outer rim of a trim breaker toward an inner edge of the trim breaker and spaced apart from the inner edge of the trim breaker.

According to another aspect, each rib of a second pair of outer ribs is spaced apart from a corresponding rib of a first pair of outer ribs.

According to another aspect, a trim breaker for an appliance includes first and second opposing vertical portions and a central portion integrally formed with the first and second opposing vertical portions. A plurality of ribs extends from an outer rim of at least one of the first and second vertical portions and at least partially along the central portion. The plurality of ribs includes at least one central rib and at least one angled rib.

According to another aspect, at least one central rib of a plurality of ribs is substantially horizontal and extends between upper and lower inner edges of a trim breaker.

According to another aspect, at least one angled rib of a plurality of ribs includes an interior angled rib and an exterior angled rib. Each of the interior and exterior angled ribs extends toward one of upper and lower inner edges of a trim breaker.

According to another aspect, an interior angled rib is positioned between a central rib and an exterior angled rib.

According to another aspect, an outer rim of a trim breaker defines a space proximate a central portion, and a plurality of ribs is integrally formed with the outer rim proximate the space.

According to yet another aspect, a trim breaker for an appliance includes first and second opposing vertical portions, a top portion, and a bottom portion. The top portion is integrally formed with each vertical portion at a respective upper corner, and the bottom portion is integrally formed with each vertical portion at a respective lower corner. An outer rim extends about a periphery of the first and second opposing vertical portions, the top portion, and the bottom portion. An inner edge of the trim breaker defines an opening and is interior of the outer rim. A plurality of ribs extends from the outer rim of at least one of the first and second vertical portions and across at least one of the upper and lower corners. The plurality of ribs includes at least one central corner rib extending from the outer rim toward the inner edge.

According to another aspect, a central corner rib is integrally formed with an outer rib. The outer rib extends substantially perpendicular to an outer rim of a portion of a trim breaker.

According to another aspect, an outer rib is integrally formed with one of a central corner rib and an inner edge of a trim breaker.

According to another aspect, a central corner rib is integrally formed with an outer rim of a trim breaker and an inner edge of the trim breaker.

According to another aspect, each of a second plurality of ribs is spaced apart from an inner edge of a trim breaker.

According to another aspect, a trim breaker includes a first surface offset from a second surface by a step. Each of a second plurality of ribs includes a lip configured to be aligned with the step.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A trim breaker for an appliance, comprising:

first and second opposing vertical portions, a top portion, and a bottom portion, which form corners and are configured to extend between an inner liner and an outer wrapper of a refrigerating appliance;

an outer rim extending about a periphery of the trim breaker;

an inner edge spaced interiorly from the outer rim;

a central corner rib extending from the outer rim and positioned diagonally across one of the corners, the central corner rib projecting from an exterior surface of the trim breaker; and a pair of outer ribs positioned on opposing sides of the central corner rib and projecting from an exterior surface of the trim breaker, wherein the pair of outer ribs are integrally formed with the central corner rib proximate the inner edge, thereby forming a joint.

2. The trim breaker of claim 1, wherein the outer rim and the inner edge project outward.

3. The trim breaker of claim 1, wherein each of the central corner rib and the pair of outer ribs are integrally formed with the outer rim of the trim breaker such that each of the central corner rib and the pair of outer ribs are made of a material having low thermal conductivity.

4. The trim breaker of claim 1, wherein the central corner rib extends from the outer rim to the inner edge.

5. The trim breaker of claim 1, wherein each of the pair of outer ribs are integrally formed with the outer rim of the trim breaker.

6. The trim breaker of claim 1, wherein the pair of outer ribs extends substantially perpendicularly from the outer rim toward the inner edge.

7. The trim breaker of claim 1, wherein the pair of outer ribs are integrally formed with the inner edge.

8. The trim breaker of claim 1, further comprising:

a second pair of outer ribs extending substantially perpendicularly from the outer rim toward the inner edge and spaced apart from the inner edge of the trim breaker.

9. The trim breaker of claim 8, wherein each rib of the second pair of outer ribs is spaced apart from a corresponding rib of the pair of outer ribs.

10. A refrigerator appliance comprising:

a cabinet including an inner liner spaced apart from an outer wrapper;

a trim breaker extending between the inner liner and the outer wrapper to define an insulating cavity therebetween, the trim breaker, comprising:

first and second opposing vertical portions, a top portion, and a bottom portion;

an interior surface facing the insulating cavity;

an exterior surface opposite the interior surface;

an outer rim extending about a periphery of the trim breaker;

an inner edge spaced interiorly from the outer rim;

a first surface proximate the inner edge;

a second surface proximate the outer rim; and a pair of parallel ribs projecting from the exterior surface of the trim breaker and extending from the outer rim toward the inner edge, wherein the first surface extends outward from the second surface, thereby forming a plateau.

11. The refrigerator appliance of claim 10, wherein the pair of parallel ribs extend perpendicularly from the outer rim and across one of the bottom portion and the first and second opposing vertical portions.

12. The refrigerator appliance of claim 10, wherein the pair of parallel ribs are spaced apart from the inner edge.

13. The refrigerator appliance of claim 10, wherein the pair of parallel ribs are integrally formed with the inner edge.

14. The refrigerator appliance of claim 10, wherein the pair of parallel ribs each include a lip configured to accommodate an offset between the first and second surfaces.

15. A trim breaker for an appliance, comprising:

an interior surface configured to face an insulating cavity of the appliance;

an exterior surface opposite the interior surface;

first and second opposing vertical portions, a top portion, and a bottom portion, the top portion integrally formed with each vertical portion at respective upper corners and the bottom portion integrally formed with each vertical portion at respective lower corners;

an outer rim extending about a periphery of the first and second opposing vertical portions, the top portion, and the bottom portion;

an inner edge defining an opening, wherein the inner edge is interior of the outer rim;

a first surface proximate the inner edge and a second surface proximate the outer rim; and at least one pair of parallel ribs projecting from the exterior surface of the trim breaker and extending from the outer rim toward the inner edge, wherein the first surface extends outward from the second surface, thereby forming a plateau.

16. The trim breaker of claim 15, wherein the at least one pair of parallel ribs extend perpendicularly from the outer rim and across one of the bottom portion and the first and second opposing vertical portions.

17. The trim breaker of claim 15, wherein the at least one pair of parallel ribs are spaced apart from the inner edge.

18. The trim breaker of claim 15, wherein the at least one pair of parallel ribs are integrally formed with the inner edge.

19. The trim breaker of claim 15, wherein the at least one pair of parallel ribs further comprise:

a first pair of parallel ribs; and a second pair of parallel ribs, wherein the first pair of parallel ribs and the second pair of parallel ribs are perpendicular to each other and positioned proximate one of the upper corners and the lower corners.

20. The trim breaker of claim 15, wherein the at least one pair of parallel ribs each include a lip configured to accommodate an offset between the first and second surfaces.

* * * * *